United States Patent [19]

Allen et al.

[11] 4,450,913

[45] May 29, 1984

[54] SUPERHEATED SOLVENT METHOD FOR RECOVERING VISCOUS PETROLEUM

[75] Inventors: Joseph C. Allen; Robert E. Gillespie, both of Bellaire; David B. Burnett, Carrollton, all of Tex.

[73] Assignee: Texaco Inc., White Plains, N.Y.

[21] Appl. No.: 388,389

[22] Filed: Jun. 14, 1982

[51] Int. Cl.[3] ..... E21B 43/24; E21B 43/40

[52] U.S. Cl. ..... 166/303; 166/263; 166/266; 166/267; 166/272

[58] Field of Search ..... 166/266, 263, 272, 303, 166/267

[56] References Cited

U.S. PATENT DOCUMENTS

| | | | |
|---|---|---|---|
| 2,412,765 | 12/1946 | Buddrus et al. | 166/263 X |
| 2,880,801 | 4/1959 | Crump | 166/266 X |
| 3,266,569 | 8/1966 | Sterret | 166/263 |
| 3,358,756 | 12/1967 | Vogel | 166/266 |
| 3,512,585 | 5/1970 | Allen | 166/245 |
| 3,768,559 | 10/1973 | Allen et al. | 166/272 |
| 3,837,401 | 9/1974 | Allen et al. | 166/303 |
| 3,910,351 | 11/1975 | Wu et al. | 166/276 |
| 3,951,210 | 4/1976 | Wu et al. | 166/288 |
| 3,954,139 | 5/1976 | Allen | 166/272 |
| 3,954,141 | 5/1976 | Allen et al. | 166/274 |
| 3,978,926 | 9/1976 | Allen | 166/267 |
| 4,004,636 | 1/1977 | Brown et al. | 166/272 |
| 4,007,785 | 2/1977 | Allen et al. | 166/263 |
| 4,008,764 | 2/1977 | Allen | 166/266 |
| 4,022,277 | 5/1977 | Routson | 166/303 X |
| 4,033,411 | 7/1977 | Goins | 166/303 X |
| 4,127,170 | 11/1978 | Redford | 166/252 |
| 4,141,415 | 2/1979 | Wu et al. | 166/252 |
| 4,271,905 | 6/1981 | Redford et al. | 166/263 |
| 4,407,369 | 10/1983 | Kydd | 166/303 X |

OTHER PUBLICATIONS

Gates, G. L. and Caraway, W. H., Solvent Simulation of Viscous Crude-Oil Production, No. SPE3680, Paper for: 42nd Annual California Regional Meeting of the Society of Petroleum Engineers of AIME, Los Angeles, California, Nov. 4–5, 1971.

Redford, D. A. and McKay, A. S., Hydrocarbon-Steam Processes for Recovery of Bitumen from Oil Sands, No. SPE 8823, Paper for: First Joint SPE/DOE Symposium on Enhanced Oil Recovery, Tulsa, Oklahoma, Apr. 20–23, 1980.

*Primary Examiner*—George A. Suchfield

*Attorney, Agent, or Firm*—Carl G. Ries; Jack H. Park; Harold J. Delhommer

[57] ABSTRACT

The disclosed invention is a method for efficiently recovering viscous petroleum from hydrocarbon formations, particularly consolidated tar sand formations. A superheated paraffinic solvent under elevated pressure and temperature is injected into the formation. Thereafter, the formation is rapidly produced until pressure is depleted. The injection and production depletion cycle is then repeated.

4 Claims, No Drawings

SUPERHEATED SOLVENT METHOD FOR RECOVERING VISCOUS PETROLEUM

FIELD OF THE INVENTION

This invention relates to an enhanced oil recovery method for viscous petroleum. More particularly, the method concerns the injection of a superheated paraffinic solvent along with a series of formation pressure depletions to produce hydrocarbons.

BACKGROUND OF THE INVENTION

Many subterranean hydrocarbon formations exist throughout the world from which hydrocarbons cannot be recovered by conventional means. Often, this is because the hydrocarbons contained therein are so viscous as to be essentially immobile at formation temperatures and pressures. Much of the viscous hydrocarbon formations in the world exist in the form of tar sands. Tar sands consist of sand saturated with a highly viscous petroleum material not recoverable in its natural state through a well with ordinary production methods. The hydrocarbons contained within the sand deposits are generally highly bituminous in character. The sand grains may be tightly packed in the tar sand formation, and in some cases, such as in the tar sand deposits in Utah, the sand grains may be highly consolidated.

Viscous oil deposits are very difficult to produce, and in many cases, cannot be produced economically with existing technology. Present methods for producing viscous oil deposits include thermal injection with steam and various combustion gases, in situ combustion, solvent injection, and in the case of tar sands, strip mining.

PRIOR ART

When hydrocarbon solvents are injected into a formation for enhanced recovery, the prior art invariably suggests the use of aromatic hydrocarbons or relatively high molecular weight hydrocarbons. See, G. Gates and W. Caraway, SPE 3680, Solvent Stimulation of Viscous Crude-Oil Production, Presented at the 42nd Annual California Meeting of the Society of Petroleum Engineers of AIME in Los Angeles, Calif., Nov. 4–5, 1971.

U.S. Pat. Nos. 3,512,585; 3,954,141; 3,978,926 and 4,141,415 disclose the injection of a hydrocarbon solvent to increase production of petroleum. U.S. Pat. No. 3,512,585 emphasizes the injection of a non-aqueous fluid at an elevated temperature sufficient enough to vaporize the connate water in order for the vaporized connate water to provide a water drive. The disclosed process requires a large excess quantity of heat to supply the heat of vaporization to the connate water. The injection of a hydrocarbon solvent, is also disclosed in U.S. Pat. No. 3,954,141 which requires that at least one component of the hydrocarbon solvent mixture be a gas and a second component be a liquid at formation conditions. U.S. Pat. Nos. 4,004,636 and 4,007,785 are related patents disclosing the same general process of U.S. Pat. No. 3,954,141.

U.S. Pat. No. 3,978,926 approaches the problem from the standpoint of allowing liquid solvents to soak in the formation without elevated temperatures or pressures. U.S. Pat. No. 4,141,415 describes the use of injected solvents into non-adjacent intervals in the same formation to increase permeability for later steam and water floods.

Several patented methods have developed the course of injecting a solvent mixed with steam or a carrier gas to lower viscosity. See U.S. Pat. Nos. 4,008,764 and 4,127,170; and David Redford, Alex McKay, SPE 8823, Hydrocarbon-Steam Processes for Recovery of Bitumen from Oil Sands, Presented at the First Joint SPE/DOE Symposium on Enhanced Oil Recovery at Tulsa, Okla., Apr. 20–23, 1980. U.S. Pat. No. 4,127,170 and SPE 8823 additionally disclose the use of controls on formation pressure by increasing and decreasing formation pressure within narrow ranges by controlling production and injection pressure. The methods disclosed in both descriptions, however, are quite complex and require the injection of a combination of steam and a hydrocarbon solvent.

SUMMARY OF THE INVENTION

This invention provides a method for efficiently recovering viscous petroleum from a subterranean hydrocarbon formation penetrated by one or more wells. By injecting a superheated paraffinic solvent and employing a series of rapid formation pressure depletions, production of viscous petroleum is substantially increased in viscous oil reservoirs. The process is particularly successful with tar sand formations that are tightly consolidated.

In the most preferred embodiment, superheated pentane is injected into the formation through one or more injection wells at an elevated pressure sufficient to dissolve the pentane into the viscous petroleum and raise the formation pressure. Injection of pentane or other paraffinic solvent is then discontinued. Thereafter, the formation is produced through production wells without restriction to rapidly deplete pressure, allowing formation pressure to fall substantially below the pressure which existed prior to injection. This pressure depletion and associated production is continued until hydrocarbon production ceases or become relatively insignificant. Production is then terminated and the entire sequence is repeated again.

The invention can, of course, be practiced in conjunction with various flooding processes, including steam, water, surfactants and polymers. In embodiments involving separate injection and production wells, it is desirable to first establish a communication path between the separate injection and production wells. The invention may also be practiced with a single well, wherein a soak period is employed between the injection and pressure depletion steps.

DETAILED DESCRIPTION

The inventive method disclosed herein is to be employed with subterranean hydrocarbon formations containing viscous oils. The invention achieves substantial usefulness when employed to recover bituminous petroleum from tar sand deposits. In tar sand formations, the sand grains may be tightly packed. Heavy bituminous petroleum with an API gravity ranging from about 5 to 8 fills a percentage of pore space between the sand grains. The viscosity of such bituminous petroleum is generally in the range of several million centipose at formation temperatures. The recovery of petroleum from tar sand deposits is even more difficult when the sand grains are consolidated. Such cementation of sand grains with a meterial such as calcite, substantially increases the cost of recovery and may prevent the economic recovery of viscous petroleum from consolidated tar sand deposits with the methods of the prior art.

The consolidated tar sands which exist in Utah provide examples of these difficult formations. These consolidated tar sands have not been economically produced by steam or in situ combustion. The bituminous petroleum contained therein remains highly viscous even at normal thermal recovery temperatures of 300°-400° F. Matrix permeabilities in such consolidated formations are an order of magnitude lower than the Canadian tar sands. Permeabilities range from 20-300 millidarcies in the consolidated Utah sands as opposed to 200-1000 millidarcies in the Canadian sands. The above permeability values are for partially cleaned cores. Permeabilities for virgin cores may approach zero.

Although the invention may be applied to the formation penetrated by only one well in a modified huff-and-puff technique, it is preferably employed with a formation penetrated by two or more spaced apart wells. At least one well should be completed as an injection well and at least one well completed as a production well. It is preferred to have a means of communication existing between the injection and production well prior to the practice of the invention, but it is not essential.

Optimum results are ordinarily obtained with the use of more than two wells, and it is usually preferable to arrange the wells in some pattern that is well known in the art. An efficient pattern for the application of the process is a five spot pattern, in which an injection well is surrounded by four production wells, or a line drive pattern in which a series of aligned injection wells and a series of aligned production wells are utilized to improve horizontal sweep efficiency.

If it is determined that the formation posesses a sufficient initial permeability to allow for the injection of steam and other fluids at a satisfactory rate without the danger of plugging, the process may be applied without any prior treatment of the formation. But this is not usually the case with the very difficult to produce, consolidated tar sands of Utah. In these formations, it is usually necessary to first apply some process to gradually increase the injectivity of the formation so that well to well communication can be established. Many such methods are well known in the art of oil recovery, and include fracturing with varying subsequent treatments to expand the fractures into well-to-well communication zones. In some instances, it may be sufficient to inject non-condensable gases, solvents or steam into the formation to produce communication paths.

In the preferred embodiment involving two or more injection and production wells, a paraffinic solvent for hydrocarbons having four or more carbon atoms is injected into the formation through one or more injection wells. Simultaneously, production is restricted or stopped in the production wells to permit formation pressure to increase with the solvent injection. The solvent is injected at an elevated pressure sufficient to dissolve the solvent into the subterranean hydrocarbons, rendering the hydrocarbons mobile. In consolidated tar sands, such as the Utah tar sands, injection pressures will normally be within the range of about 1800-2500 kilopascals.

Injection temperature must be sufficient to vaporize the solvent, but not vaporize large quantities of connate water at the formation pressure. In the consolidated tar sands of Utah, injection temperature will generally be in the range of about 200° to about 260° C. Some connate water will, of course, be vaporized. But vaporizing the connate water requires large quantities of BTUs to impart the heat of vaporization. Thus, as much as possible, it is important to avoid vaporizing substantial quantities of connate water.

The paraffinic solvents must have sufficient solvent qualities so as to dissolve into the bituminous petroleum entrained in the tar sands. Additionally, the solvent must not be a light molecular weight compound such as methane or ethane. The paraffinic solvents should be selected from the group consisting of butane, pentane, hexane, heptane and octane. Superheated pentane is the preferred solvent of choice.

After the injection of the solvent has ceased, the depletion portion of the pressurization-depletion cycle is begun. Hydrocarbons are produced without restriction from the producing well or wells until hydrocarbon production ceases or becomes relatively insignificant. By this production without restriction, formation pressure is depleted to a level substantially below the pressure which existed prior to injection.

The injected solvent is recovered along with the produced hydrocarbons, separated from the produced hydrocarbons, and then recycled to the injection wells. The entire cycle of injection and pressure depletion is then repeated. Because of the cost of injection, the injection and depletion cycle is preferably repeated only once.

The total pore volume of injected superheated solvent should be within the range of about 0.05 to about 1.3 pore volumes cumulative for both cycles. In a multiple well embodiment, using separate injection and production wells, larger total quantities of solvent will normally be injected into the formation than in the single well embodiment of injection, soaking and depletion. Ordinarily, the injection of large quantities of hydrocarbon solvent would not be economically feasible. However, since about 90-95 percent of the injected solvent can be recovered from the produced hydrocarbons and recycled to the injection well or wells, the process becomes economical. Additionally, the high solvent efficiency rates of the present invention further improve the economics. Solvent efficiency is defined as the quantity of bitumen recovered per unit of solvent injected.

The following examples will further illustrate the enhanced oil recovery method of the present invention by injecting a superheated paraffinic solvent. They are given by way of illustration and not as limitations on the scope of the invention. Thus, it should be understood that solvents, properties of solvents, time, temperatures and pressures of the process may be varied with much of the same results achieved.

Laboratory tests were performed to demonstrate the operability of the present invention. A high pressure, high temperature cell was employed for flooding cores of consolidated tar sands. A core from the Utah tar sands with a length of 5.75 inches, an outside diameter of 2 inches and a ½ inch center drilled bore, was mounted in the cell. The core had a porosity of 30%, a permeability of several hundred millidarcies and an oil saturation of 57%.

An electric heater and thermocouple were inserted in a special heat treated, stainless steel tube mounted in the inner bore of the tar sand core. The top of the cell closure was fitted with an injection port. Injected fluids flowed into the annulus between the heating tube and the core and then radially outward to the periphery of the core, and to four collection ports all communicating with a tube for flow out of the bottom of the cell.

EXAMPLE I

The core was saturated with pressurized nitrogen at 2170 kilopascals. The nitrogen was bled from the cell until cell pressure reached atmospheric pressure. The electric heater was then used to heat the cell to 238° C. and superheated pentane at 238° C. was injected. Pressure increased to 2170 kilopascals and production started from the collection ports after injection of 33 milliliters of pentane. The injection rate thereafter was 16 milliliters per hour at 2170 kilopascals. Five very uniform production samples were taken the first day.

The cell was then shut in and the core soaked over night under 2170 kilopascals of pentane. Injection and production continued on the second day ending with a pressure depletion down to atmospheric pressure over a period of 30 to 60 minutes. Then the cell was repressured with pentane and allowed to soak for a second night. Injection, production and a second pressure depletion step occurred the third day until a total of 108.5 milliliters of pentane had been injected. The amount of injected pentane was equivalent to 1.44 pore volumes.

48.54 grams of bitumen was produced from an original 51 grams of bitumen in the tar sand core. This production was 95% of the bitumen in the tar sand core. Solvent efficiency, which is defined as barrels of bitumen produced per barrel of solvent injected, was an unexpectedly high 0.643. In addition, 90–95% of the injected pentane was recovered. Such a high recovery rate of pentane and bitumen produced per unit of solvent injected make the economics of the present invention possible.

EXAMPLE II

In Example II, a core was prepared in a manner similar to Example I and saturated with nitrogen at 2170 kilopascals. While the heater was being maintained at 232°–245° C. superheated pentane at 232° C. was injected. First production occured after about 28 milliliters of pentane had been pressurized into the cell. A very high injection rate of 160 milliliters per hour was maintained for less than an hour. Samples were taken at intervals of 8–10 milliliters of injected superheated pentane. The cell was allowed to soak over night under pressure. On the second day the injection rate was reduced to 16 milliliters per hour, which greatly improved production efficiency. Thus, there is a strong correlation between high injection rates and decreased production efficiency in the practice of the present method.

After a total of about 109.2 milliliters (1.44 pore volumes) had been injected the cell pressure was depleted to atmospheric pressure within one hour. Fifty-five percent of the bitumen in the core was recovered at this point.

Cold water flooding at 2170 kilopascals was then tried, which increased the recovery of bitumen to 59%. Production was fair during the cold water flooding until the core cooled off. The heater was then turned on and the temperature increased to 232° C. before injecting 110 milliliters of water at 2170 kilopascals, which turned to steam upon contact with the core. Finally, the heater was turned off and the cell pressure bled to atmospheric pressure within one hour.

Total bitumen production was 41.4 grams from a possible 51 grams, yielding 81.1 percent bitumen recovery. Solvent efficiency was 0.503. About 90–95% of the injected pentane was also recovered.

The enhanced recovery of oil by the use of the novel injection and pressure depletion process disclosed herein can be performed by varying the solvent and basic steps. Many variations of this invention will be apparent to those skilled in the art from the foregoing discussion and examples. Variations can be made without departing from the scope and spirit of the following claims.

We claim:

1. A method for recovering hydrocarbons from a subterranean hydrocarbon formation penetrated by at least one well, consisting essentially of:

(a) injecting into the hydrocarbon formation through a well a fluid consisting essentially of superheated solvent selected from the group consisting of butane, pentane, hexane, heptane, and octane, while simultaneously restricting production to increase formation pressure, (b) said solvent being injected at an elevated pressure sufficient to dissolve the solvent into the subterranean hydrocarbons, rendering the hydrocarbons mobile;

(c) ceasing the injection of the solvent;

(d) depleting formation pressure to substantially below the pressure which existed prior to injection by producing hydrocarbons without restriction until hydrocarbon production becomes relatively insignificant;

(e) recovering the injected solvent along with the produced hydrocarbons; and (f) repeating the above injection and pressure depletion sequence.

2. The method of claim 1, wherein the hydrocarbon formation comprises tar sands of a low API gravity.

3. The method of claim 2, wherein the tar sands are consolidated.

4. A method for recovering hydrocarbons from a subterranean hydrocarbon formation containing tar sands, penetrated by at least one well, consisting essentially of (a) injecting a fluid consisting of superheated pentane into the tar sand formation through a well, while simultaneously restricting production to increase formation pressure;

(b) said superheated pentane being injected at a temperature of about 200° to about 260° C. and an elevated pressure of about 1800 to about 2500 kilopascals;

(b) ceasing injection of pentane;

(c) depleting formation pressure to substantially below the pressure which existed prior to injection by producing hydrocarbons without restriction until hydrocarbon production becomes relatively insignificant;

(d) recovering the injected pentane along with the produced hydrocarbons; and (e) repeating the above injection and pressure depletion sequence.

* * * * *